US008502634B2

(12) United States Patent
Gruber et al.

(10) Patent No.: US 8,502,634 B2
(45) Date of Patent: Aug. 6, 2013

(54) INDUCTIVE ELECTRONIC MODULE AND USAGE OF SUCH

(75) Inventors: Stephan Gruber, Chemnitz (DE); Rene Franzky, Chemnitz (DE); Winfried Beyer, Chemnitz (DE)

(73) Assignee: Exscitron GmbH, Chemnitz (DE)

( * ) Notice: Subject to any disclaimer, the term of this patent is extended or adjusted under 35 U.S.C. 154(b) by 0 days.

(21) Appl. No.: 13/601,129

(22) Filed: Aug. 31, 2012

(65) Prior Publication Data

US 2013/0057164 A1 Mar. 7, 2013

(30) Foreign Application Priority Data

Sep. 2, 2011 (EP) ..... 11179951

(51) Int. Cl.
*H01F 5/00* (2006.01)

(52) U.S. Cl.
USPC ..... 336/200

(58) Field of Classification Search
USPC ..... 336/170, 173, 178, 200, 232
See application file for complete search history.

(56) References Cited

U.S. PATENT DOCUMENTS

2003/0197585 A1 10/2003 Chandrasekaran et al.
2004/0145445 A1 7/2004 Yang

FOREIGN PATENT DOCUMENTS

WO 2011/047817 A1 4/2011
WO 2011/047819 A1 4/2011

*Primary Examiner* — Tuyen Nguyen
(74) *Attorney, Agent, or Firm* — Kacvinsky Daisak PLLC

(57) ABSTRACT

An inductive electronic module comprises a planar core element having an inner limb and at least two lateral limbs, to which winding arrangements are assigned for forming a transformer. First and second partial windings are formed on first and second of the lateral limbs such that a resulting magnetic flux of the first planar winding arrangement is cancelled in the inner limb and the second planar winding arrangement is magnetically decoupled from the first planar winding arrangement on the inner limb. The inner limb has a first core section for interacting with the second planar winding arrangement and a second core section spaced from the first core section on the core element. The second core section interacts with an additional planar winding arrangement, which forms a series connection with the second planar winding arrangement. The second core section implements a magnetically active air gap for the additional planar winding arrangement.

10 Claims, 2 Drawing Sheets

INDUCTIVE ELECTRONIC MODULE AND USAGE OF SUCH

FIELD OF THE INVENTION

The present disclosure relates in general to an inductive electronic module, and more particularly to the use of such an inductive module in a current dividing device, particularly in conjunction with a resonant converter topology.

BACKGROUND

A generic inductive electronic module is known from WO 2011/047819, which discloses an inductive electronic module for use in producing a multiple transformer assembly, with which, for example, according to FIG. 4 of WO 2011/047819, a current dividing device for supplying current to a plurality of consumers can be implemented. This advantageously comprises a planar core element, which, when connected in pairs with a circuit board that supports planar windings, can be used to implement a plurality of transformers that are magnetically decoupled from one another, in a manner that is simple in terms of production engineering and is highly magnetically efficient.

More particularly, WO 2011/047819 describes the possibility of allowing respective winding arrangements that implement the transformers to interact with the inner limbs and/or the lateral limbs in such a way that within the compact geometry, and therefore, in terms of components, by means of a pair of planar core elements, each in the form of a single piece, four or more transformers that are magnetically decoupled from one another can be set up.

In particular, the embodiment of the generic circuit board as a multilayer and/or stacked arrangement of a plurality of circuit boards, each supporting planar windings and having openings suitably adapted to the projections of the pair of planar core elements, supports the implementation of a correspondingly compact design.

However, an embodiment of a multiple transformer assembly that can be implemented using this known technology, based upon the current divider circuit disclosed in FIG. 4 of the WO 2011/047819, for example, in a resonant converter topology would necessitate additional expense for implementing the series and/or resonance inductor on the primary side of the main transformer (TR1 in FIG. 4 of WO 2011/047819), which is necessary for the resonant converter and is series connected to the primary winding (not shown in FIG. 4). If, for example, a circuit of the type outlined in FIG. 4 were to be implemented utilizing a generic planar core element (FIG. 6 of WO 2011/047819), although all the transformers TR1, TR2, TR4, TR5 could be implemented on said planar core element (or on a pair of said planar core elements facing one another), there would not be enough space for an additional inductor, as would be required for the resonant converter topology, and said additional inductor would also necessitate additional expenditure on components (or the provision of additional lateral limbs, which would in turn negatively affect the compactness of the module and/or would require additional expenditure).

SUMMARY OF THE INVENTION

The problem addressed by the present disclosure is therefore that of configuring and further developing a generic inductive electronic module in such a way a topology of this type can be implemented with the help of the inductive electronic module, within the available dimensions and/or peripheral contours of the planar core element and particularly without requiring additional external components or modules for a primary-side series and/or resonance inductor for implementing a resonant converter. In so doing, particularly the same external dimensions as are enabled for the generic prior art are to be implemented but not exceeded.

The problem is solved by the inductive electronic module having the features of the main claim. Moreover, within the scope of the present disclosure, protection is claimed for the use of an inductive electronic module of this type for a current dividing device and/or for implementing a resonant converter having a plurality of transformers, which are provided on the planar core element according to the present disclosure (or on a pair of core elements implemented therefrom).

In an advantageous manner according to the present disclosure, and in a further development of or departure from the prior art (wherein, both with respect to the concrete geometric and magnetic embodiment of circuit board(s) and core element and with respect to the current divider circuit implemented with these, the content of WO 2011/047819 is considered included as part of the present disclosure), the inner limb is embodied for implementing two core sections, wherein the first core section of the inner limb (still) interacts with the second planar winding arrangement for the purpose of implementing, for example, the input-side (main) transformer of a resonant converter. In this case, however, the inner limb, expanded by the second core section, which is spaced from the first core section, which is still arranged between the lateral limbs assigned to both sides, enables the implementation of series and/or resonance inductor.

In this case, this embodiment of the inner limb (for implementing the input-side transformer on one hand and the associated primary-side series and/or resonance inductor on the other hand) does not result in a magnetic decoupling of these winding arrangements. This is because, in accordance with the resonant converter topology, the series and/or resonance inductor is nevertheless series connected to the primary winding of the input-side transformer (implemented as the second planar winding arrangement as specified in the present disclosure), and assuming the corresponding signals are synchronous, this is magnetically innocuous.

Within the framework of the present disclosure, the measure according to the present disclosure of configuring the second core section so as to implement an air gap ensures that the series and/or resonance inductor that is thereby formed is capable of properly fulfilling its function as an energy store, and that magnetic saturation effects do not impair the primary side of the input transformer.

Therefore, according to the present disclosure, the series and/or resonance inductor that is used for implementation of the resonant converter can also be advantageously housed within the framework of the arrangement, without having to geometrically enlarge the planar core element or expand it by additional discrete components. This provides the advantages of the generic technology in terms of assembly and large-scale production to also be utilized.

In the implementation of the present disclosure, it is particularly preferable for the (at least one) circuit board that supports the planar winding arrangements to be configured with the help of suitable openings, such that, in the manner of planar transformer arrangements, the pair of planar core elements that engage on both sides with and/or on the circuit board are able to engage with respective projections ("raised areas" as specified in the present disclosure) into these openings in the circuit board.

When, based upon the corresponding configuration of these raised areas, the respective planar core elements come in contact with one another in such an opening, a gap-free core region is implemented, whereas somewhat shallower raised areas of the respective planar core elements of the pair, facing one another, enable the formation of an air gap in the circuit board opening. This is preferably the case with the implementation of the series and/or resonance inductor in the primary circuit of the input-side transformer (wherein the additional planar winding arrangement implements this series and/or resonance inductor with a working air gap, whereas the associated primary winding, which can be implemented, for example, by means of the second planar winding arrangement and in conjunction with the first core section on the inner limb, like the additional transformers on the lateral limbs, is implemented without an air gap).

Although it is preferable within the framework of the present disclosure to use the resonant converter topology in the use of the present disclosure for implementing a current dividing device, which can be configured on the basis of a suitably selected chaining of transformers and for the purpose of implementing an embodiment as described in WO 2011/047817, the present disclosure is not limited to this use or to this implementation. Rather, the present disclosure makes it possible, in a surprisingly simple and elegant manner, to also implement the additional series and/or resonance inductor within the framework of a multiple transformer arrangement on a common planar core element (or on a pair of core elements formed therefrom), with the magnetic decoupling and/or independence of this plurality of transformers, by dividing the inner limb into first and second core sections.

The present disclosure embodies the further development of the generic technology, without requiring any additional expenditure on components, and without requiring modification of the external geometry or the provision of additional lateral limbs.

BRIEF DESCRIPTION OF THE DRAWINGS

Further advantages, features and details of the disclosure are found in the following description of preferred embodiment examples of the disclosure and in reference to the set of drawings; the drawings show.

DETAILED DESCRIPTION

Figure 1:
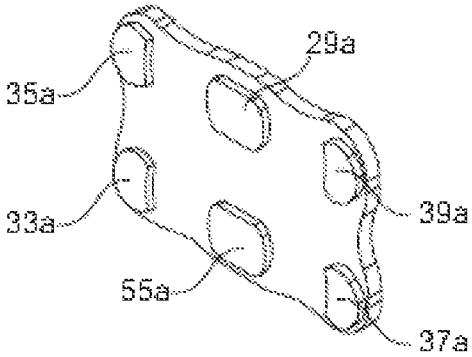
FIG. 1 is a perspective illustration of a planar core element (as one half of a pair) according to a first exemplary embodiment.
Figure 2:
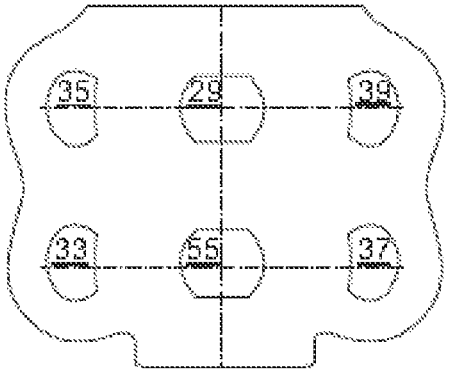
FIG. 2 is a schematic outline of a circuit board that interacts with the planar core element of FIG. 1, according to the illustrated first exemplary embodiment.

FIGS. 1 and 2 show a schematic illustration of an exemplary embodiment of the disclosed inductive electronic module. In this embodiment, the planar core element shown in the perspective illustration of FIG. 1 corresponds to the core element shown in FIG. 6 of WO 2001/047819. As such, corresponding reference signs have been chosen for identical and/or corresponding sections and/or components, and with regard to the present disclosure and with regard to practicability, reference is made to FIG. 6 and to the relevant description, with the exception that the size of the generic inner limb (reference sign 29*a* in FIG. 6 of WO 2011/047819) is decreased, and additionally, in the center region between the lateral limbs 33*a*, 35*a* and/or 37*a*, 39*a*, a core section 55*a* is formed (the second core section as specified in the present disclosure) from the single-piece ferrite element, spaced from the first core section 29*a*. More precisely, the raised areas 33*a*, 35*a*, 37*a*, 39*a*, formed as a single piece from the ferrite material of the planar core element of FIG. 1, each with a respectively opposite and corresponding partner, represent the lateral limbs, whereas, to implement the inner limb, the raised areas 29*a* and 55*a* are formed as the first and second core sections, respectively. As is also clear from the illustration of FIG. 1, raised area 55*a* is not as high as raised area 29*a* (referenced from the flat body section of the core element) so that, when a pair of planar core elements of FIG. 1 are positioned to face one another, the end surfaces of the mutually opposing raised areas 29*a* are in contact with one another, thereby forming a continuous ferrite limb, whereas between the raised areas 55*a* facing one another, an air gap is formed due to the lower height of these areas.

As is further clear from FIG. 2, the openings 33-39 and 29, 55, which correspond to the raised areas, are adapted to the contours of the associated raised areas.

Figure 3:
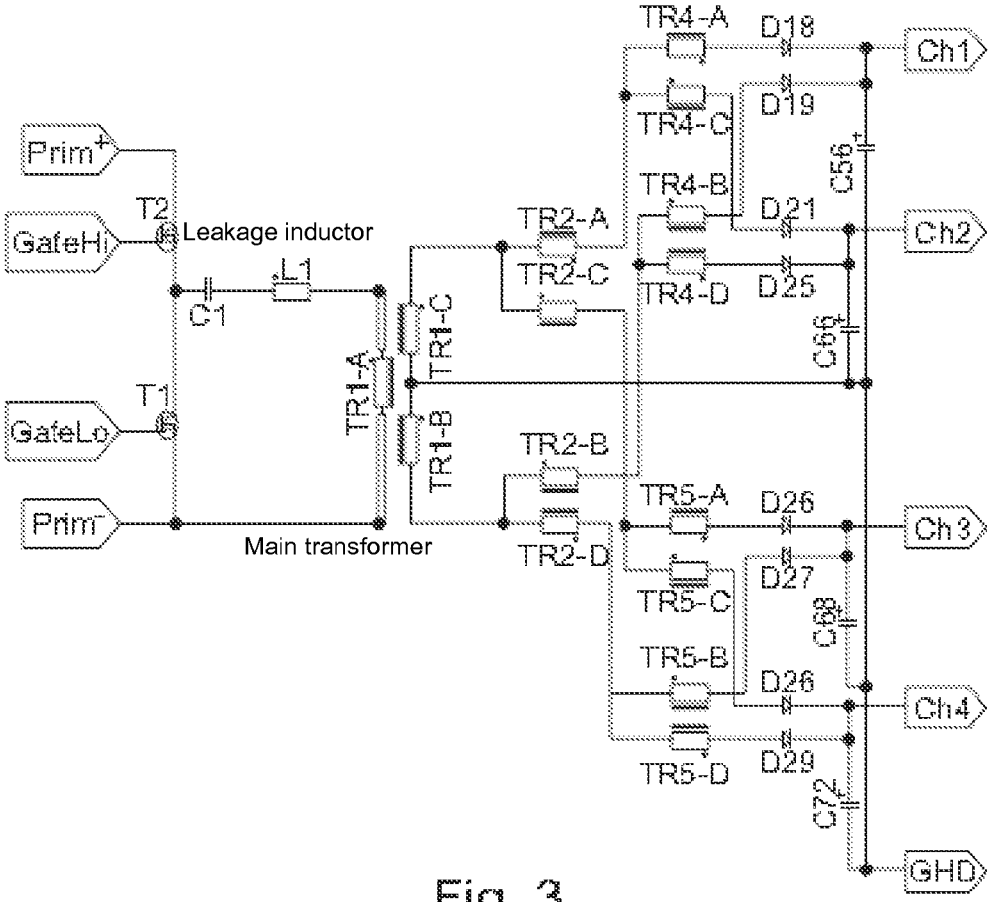
FIG. 3 is a circuit diagram illustrating an exemplary implementation of a four-branch current dividing device having four transformers, decoupled from one another, implemented on the arrangement of circuit board and core element(s) according to FIG. 1 and FIG. 2, in resonant converter topology with series and/or resonance inductor additionally connected in series on the primary side of the input transformer.

The arrangement of a planar core element (pair) and a circuit board configured in this manner then enables, for example, the implementation of a circuit having four transformers that are magnetically decoupled from one another, as is illustrated in FIG. 3 as a current-controlled resonant converter with four outputs (CH1-CH4). The secondary side of the transformer unit TR1 ("main transformer"), as the input-side transformer, is consistent with the circuit of the implementation shown in WO 2011/047819, in FIG. 4 thereof, wherein, to facilitate conformity, the reference signs are consistent, and for a further explanation of functionality of this current divider circuit for consumers to be attached to the outputs CHi, reference is made both to the description in WO 2001/047819, FIG. 4, and further, regarding the circuit principle and the mode of functioning thereof, to WO 2011/047817, particularly to the corresponding FIG. 4 therein. Associated circuit descriptions and more detailed explanations of this functional principle are likewise to be considered included in the present disclosure (as part of the present disclosure), with respect to FIG. 3 of the present application.

The circuit shown in FIG. 3 further comprises a resonant converter circuit on the primary side of the main transformer TR1, illustrated symbolically and in simplified form at switches T1, T2, a coupling capacitor C1 and a series and/or resonance inductor L1, implemented within the framework of resonant converter topology and referred to as a "leakage inductor".

The present disclosure, by means of the second core section 55*a*, enables the implementation of this series and/or resonance inductor L1, within the framework of the core element circuit board arrangement of FIG. 1 and FIG. 2, such that, in series with the planar winding arrangement formed on the first core section 29*a* for implementing the transformer TR1, this additional inductor L2 is provided on the adjoining second core section 55*a* (and is correspondingly formed as a planar winding on the circuit board of FIG. 1). Because L1 is acted on by a signal that is synchronous with the transformer TR1 (as a functionality of the resonant converter topology), it is not necessary for the planar winding arrangement formed on the second core section 55*a* to be magnetically decoupled from the planar winding arrangement of the first core section 29. To this extent, contrary to the solution described in WO 2011/047817 of the present applicant, the present disclosure advantageously eliminates the need for additional lateral limbs for implementing additional magnetic decoupling.

Because, due to the lower height of the raised area 55*a*, the pair of planar core elements facing one another generates an air gap in the transition area between the raised areas 55*a* facing one another, the series inductor L1 is high based upon the magnetic resistance (as compared with the additional limbs 29*a*, 33*a*, 35*a*, 37*a* and 39*a* with associated windings), the influence of all other magnetic modules provided on the unit on L1 is accordingly negligible. Additionally, the series inductor L1 itself does not influence the windings on the outer limbs (33*a*, 35*a*, 37*a*, 39*a*), and therefore, to this extent the functional principle according to WO 2011/047817 and WO 2011/047819 with respect to magnetic decoupling is applied. The influence of the main transformer TR1 on limb 29*a* is low, because the signals flowing through the series connection are synchronous with one another and limb (first core section) 29*a* itself has no air gap (and therefore very low magnetic resistance). Therefore, the magnetomotive force beginning at L1 (at the second core section 55*a*) drops off for the most part on the high magnetic resistance of the air gap at the raised area 55*a*. Core section 29*a* needs only to have sufficient cross-sectional area to accommodate the additional magnetic flux component of L1 in this section of the core element, so that magnetic saturation will not result. The same is true similarly of the lateral raised areas (lateral limbs) 33*a*, 35*a*, 37*a*, 39*a*—these must also offer a cross-section that is enlarged with respect to the flux input of L1. In a practical approximation, this results in a cross-sectional enlargement of the cross-sectional areas in the lateral limb region of ca. 20% over the configuration, for example, of FIG. 6 of WO 2011/047819).

A greater magnetic path length from raised area 55*a* to raised areas 35*a* and 39*a* relative to raised areas 33*a* and 37*a* is balanced by the circumstance that a magnetic path length from raised area 29*a* to raised areas 35*a* and 39*a* is smaller, by the same ratio, than the path length to raised areas 33*a* and 37*a*. Because, as has been presented, components acted on by synchronous signals are located on the two inner limb core sections 29*a* and 55*a*, the different influences thereof on the outer limbs are largely mutual.

With reference to FIGS. 4-7, an exemplary implementation of this inductive electronic module arrangement and connection with the help of a multilayer circuit board (the basic outline of which is shown in FIG. 2) will be described. In this case, an exemplary implementation results in a 10-layer multilayer, of which FIGS. 4-7 show only four layers in sectional illustrations (nevertheless describing all windings); similarly to the illustration of FIG. 2, FIG. 4 (and therefore, also FIGS. 5-7) contains an illustration of the openings 33, 35, 37, 39 and 29, 55, each corresponding to the raised areas of the planar core element (more particularly, the pair of raised areas, facing one another, on the planar core element arrangement that interacts on both sides with the multilayer circuit board).

Figure 4:
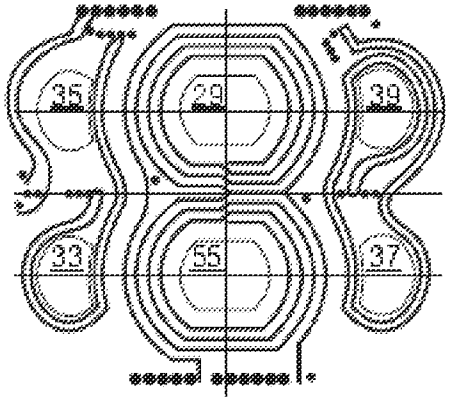
FIG. 4-FIG. 7 are exemplary views of conducting layers (winding layers) of a multilayer circuit board according to FIG. 2 for implementing the circuit according to FIG. 3.
Figure 5:
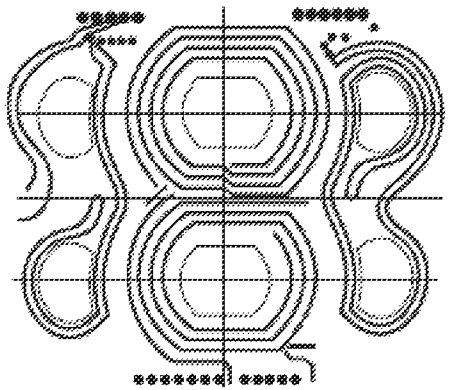
Figure 6:
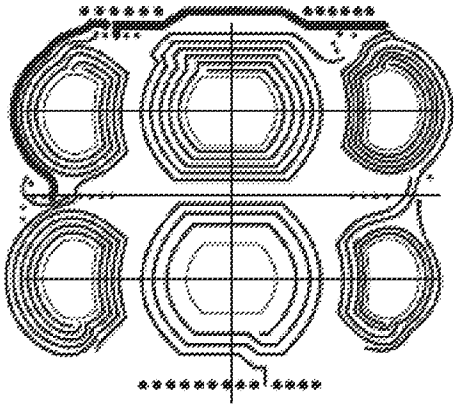
Figure 7:
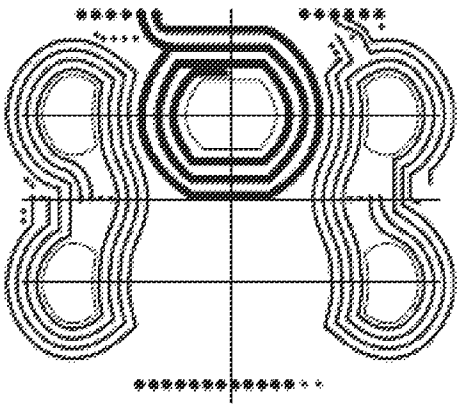

Specifically, FIG. 4 describes the fourth layer, FIG. 5 describes the sixth layer, FIG. 6 describes the ninth layer and FIG. 7 describes the tenth layer of the multilayer circuit board, where the transformer TR1 is formed with its windings A, B, C around the opening 29 (or the core section 29*a*). FIG. 4 shows the associated start of primary winding TR1-A, whereas FIG. 5 shows another part of primary winding TR1-A and illustrates the bifilar end of this winding, which is guided around the opening 55 to the connection at the bottom. By way of example, FIGS. 6 and 7 together form a complete secondary winding, in this case, winding TR1-B of the input-side transformer TR1 (with correspondingly suitable plated-through holes).

The series and/or resonance inductor L1 is wound around the opening 55 (or the pair of raised areas 55*a* with the air gap between them). FIG. 6 shows the start of this winding, FIG. 4 the winding end, and FIG. 5 the intermediate section of the winding.

Partial windings of the transformer TR2 are shown in FIGS. 4, 5 and 7, specifically in each case extending around two outer limbs/associated openings (33, 35 and 37, 39).

FIG. 6 shows partial windings of TR4 on the outer limbs (or associated openings 33, 35) and partial windings of the transformer TR5 on the outer limbs (or associated openings 37, 39).

The present disclosure is not limited to the concrete embodiment as a multilayer circuit board for implementation of the planar winding arrangements; rather, other possible implementations, for example by stacking a plurality of circuit boards or similar measures, are also conceivable. The present disclosure also is not limited to the implementation of the four transformers that are magnetically decoupled from one another; in accordance with the teaching of WO 2001/047817, the number thereof can be lower or, with a corresponding number of additional lateral limbs, even higher, as long as the additional (second) core section according to the disclosure is provided as a part of the inner limb in the center region.

The invention claimed is:

1. An inductive electronic module comprising:

a planar core element having an inner limb (29*a*, 55*a*) and at least two lateral limbs (33*a*, 35*a*, 37*a*, 39*a*) assigned to the inner limb, one on each side, to which core element planar winding arrangements are assigned to form a transformer, wherein a first of the planar winding arrangements (TR2, TR4, TR5) is implemented as a series circuit comprising two partial windings, of which a first partial winding is formed on a first of the lateral limbs and a second partial winding is formed on a second of the lateral limbs, the first and second partial windings having a winding number and a winding direction, which are configured such that a resulting magnetic flux of the first planar winding arrangement is cancelled in the inner limb, in particular it is 0, and a second of the planar winding arrangements (TR1) is formed on the inner limb, magnetically decoupled from the first planar winding arrangement, characterized in that the inner limb has a first core section (29*a*) embodied for interacting with the second planar winding arrangement (TR1), and a second core section (55*a*), which is provided spaced from the first core section on the core element and which is embodied for interacting with an additional planar winding arrangement (L1), which forms a series connection with the second planar winding arrangement, wherein the second core section is embodied such that it implements a magnetically active air gap for the additional planar winding arrangement.

2. The module according to claim 1, characterized in that the first core section is embodied such that it implements an air gap-free core for the second planar winding arrangement.

3. The module according to claim 1, characterized in that the first, the second, and the additional planar winding arrangements are embodied as conductive traces on at least one circuit board, which has openings for magnetic interaction with the core element and/or depressions for sections (33-39, 29, 55) of the core element which implement the limbs.

4. The module according to claim 1, characterized in that the core element, which is preferably embodied as a single piece, has a surface section that is embodied as planar, for interaction with a circuit board that supports at least one of the planar winding arrangements, from which surface section raised areas (33*a*-39*a*, 29*a*, 55*a*) that implement the inner limbs and the lateral limbs extend, formed thereon as a single piece.

5. The module according to claim 3, characterized in that the core element forms a first raised area (29*a*) for implementing the first core section and forms a second raised area (55*a*) for implementing the second core section, the height of which, referred to the surface section, is diminished relative to the first raised area.

6. The module according to claim 3, characterized in that a pair of core elements, provided one on each side of the circuit board, and having raised areas facing one another, engages in at least one opening in the circuit board.

7. The module according to claim 3, characterized in that the circuit board forms a multilayered structure for a plurality of conductive trace layers of the planar winding arrangements and/or is part of a layered structure of a plurality of circuit boards.

8. The module according to claim 1, characterized in that the inductive electronic module is wired as a resonant converter having a plurality of transformers implemented by the planar winding arrangements, wherein the second planar winding arrangement implements an input-side transformer and the additional planar winding arrangement forms a leakage inductor that is assigned on the primary side to the input-side transformer.

9. The use of the inductive electronic module according to claim 1 in a current dividing device, particularly for operating a plurality of LEDs as consumers, arranged in the form of strands, in which current dividing device a current present on the secondary side of a first transformer on the input side is divided into at least two consumer branches, which are actuated independently of one another, with at least one second transformer.

10. The use according to claim 9, characterized in that the first transformer and the at least one second transformer are implemented on the basis of a common core element or pair of core elements of the module, wherein the second planar winding arrangement forms the first transformer.

* * * * *